US005609808A

United States Patent [19]

Joest et al.

[11] Patent Number: 5,609,808

[45] Date of Patent: Mar. 11, 1997

[54] METHOD OF MAKING A FLEECE OR MAT OF THERMOPLASTIC POLYMER FILAMENTS

[75] Inventors: Rolf H. Joest, Duisburg; Hans G. Geus, Niederkassel; Hermann Balk, Troisdorf; Bernd Kunze, Hennef; Herbert Schulz, Troisdorf, all of Germany

[73] Assignee: Reifenhauser GmbH & Co. Maschinenfabrik, Troisdorf, Germany

[21] Appl. No.: 587,883

[22] Filed: Jan. 11, 1996

[30] Foreign Application Priority Data

Jan. 17, 1995 [DE] Germany ..... 195 01 123.6

[51] Int. Cl.[6] ..... B29C 47/88; B29C 55/16

[52] U.S. Cl. ..... 264/210.7; 264/210.87; 264/290.2; 425/72.2

[58] Field of Search ..... 264/518, 210.7, 264/210.8, 290.2; 425/72.2

[56] References Cited

U.S. PATENT DOCUMENTS 3,855,045 12/1974 Brock .
4,340,563 7/1982 Appel et al. .
4,405,297 9/1983 Appel et al. .
5,248,247 9/1993 Rubhausen et al. .
5,296,289 3/1994 Collins .
5,460,500 10/1995 Geus et al. ..... 425/66

FOREIGN PATENT DOCUMENTS

0377926A1 7/1990 European Pat. Off. .
1900265 7/1969 Germany .
4036734C1 11/1990 Germany .
4014989A1 11/1991 Germany .
4014414A1 11/1991 Germany .

*Primary Examiner*—Mary Lynn Theisen
*Attorney, Agent, or Firm*—Herbert Dubno

[57] ABSTRACT

A melt-blowing head is used to produce long thermoplastic filaments which are collected on a sieve belt and form crossing welds at cross-over points. The resulting mat may be calendered and is composed of filaments having a diameter of less than 100 μm and a degree of crystallinity which is less than 45%. The mat is heated to a stretching temperature of 80 to 150° C. and is then biaxially stretched by 100 to 400% before being thermally fixed at a higher temperature. The result is a nonwoven web which can have a greater strength for a given area weight or a reduced area weight for a given strength than earlier systems.

18 Claims, 2 Drawing Sheets

METHOD OF MAKING A FLEECE OR MAT OF THERMOPLASTIC POLYMER FILAMENTS

FIELD OF THE INVENTION

Our present invention relates to a method of producing a mat or fleece, hereinafter referred to generally as a nonwoven web, of thermoplastic polymer filaments and, more particularly, to such a web fabricated from polymers having two supermolecular states, namely a crystallitic state and an amorphous state.

BACKGROUND OF THE INVENTION

It is known to fabricate a fleece or mat of thermoplastic polymer filaments in the form of a web in which the filaments are collected in the form of a mat with point bonds or wells between the filaments where they cross one another.

The polymers used can be of the two-state type described, i.e. on a supermolecular level can be composed of crystallites imparting a crystallitic state to the polymer or can be in an amorphous state or some combination of the two, the degree of crystallinity being a measure of the proportion formed by crystallites.

Polymer filaments refer to strands of considerable length, for example, endless strands and monofilaments. They are to be contrasted with polymer fibers which are of relatively short lengths, generally referred to also as staple fibers. Suitable polymers for the purposes described herein are polyamides, polyethylene, polyesters and polypropylenes, although the invention is not to be considered limited to these polymeric materials although it is essential for the purposes of the present invention that the polymer used have the two states described. Especially stable are polyamide 6 (Nylon 6), polyamide 6.6 (Nylon 66) and polyethyleneterephthalate. The dominating parameters of the crystallitic state are the chain packing in the crystal structure, the degree of crystallinity, the crystallite orientation and the crystallite size. With such polymers, however, it is found that the chain packing in the crystallite structure can generally not be influenced by the processing conditions of the polymer. The degree of crystallinity and especially the crystallite orientation can be influenced by the processing.

Since the crystallite structure is especially stable, the molecular chains do not tend to fold back on themselves. The shrinkage of the polymers decreases with increasing degree of crystallinity. The crystallite component has an effect on strength of the filaments only insofar as the crystallite orientation extends along the filament axis. The degree of crystallinity decreases with increasing cooling speed. The higher degree of orientation of the molecular chains in the crystal structure results in a promotion of crystallinity. The term "orientation" in this sense refers not only to the orientation of the molecular chains in the amorphous region but also the orientation of the crystallites in the crystallite region. Upon stretching of the filaments, the molecules and the crystallites tend to orient in the direction of stretch. The degree of orientation depends strongly upon the thermal and mechanical stretching conditions. The stretching conditions which should be applicable can be easily determined empirically once the desiderata for such conditions are known. With increasing orientation the filament strength increases with a simultaneous reduction in the elongation and the shrinkage ratio. In the melt the molecular chains are without specific orientation and tends to be jumbled (compare ITB Garn- und Flächenherstellung 2/94, pages 8, 9).

Processes for producing a mat or fleece of thermoplastic polymer filaments are known in that a variety of techniques (see, for example, U.S. Pat. Nos. 4,340,563, 4,405,297, 3,855,045, 5,296,289, German patent 4,014,414 and German Patent 4,014,989).

The polymer filaments result from a polymer melt which is fed through nozzle orifices of a so-called spinerette to form a filament curtain. The filament curtain passes through a cooling chamber together with process air and the filament curtain then traverses a stretching passage in which stretching of the polymer filament is effected by entrainment air, e.g. by forcing the air through a constricted region which increases its velocity. The stretched polymer filament is collected on a continuously movable sieve belt to form the mat or web and generally the deposition of the polymer filament upon the belt is assisted by the application of suction below the belt.

Upon the deposition of the polymer filament on the belt, random cross-overs between the filaments results in contact points at which the crossing filaments are welded together to form the coherent web. These crossing weld points are distributed in the longitudinal direction of the web and transversely across the web.

The web can be heated (German patent 1,900,265) to a stretching temperature and then stretched both in the longitudinal direction and in the transverse direction (i.e. biaxially). The biaxially stretching can result in a reduction of the weight per unit area of the web. It is also known (see U.S. Pat. No. 5,296,289) to calender the web to ensure point weld structures between the crossing polymer filaments with diameters of the millimeter range. For this purpose the web can be passed between the pair of calender rolls and generally at least one of these rolls is heated. The degree of crystallinity of the polymer filaments determines largely the physical parameters of the polymer filaments in the mat and thus the physical parameters of the mat itself.

While nonwoven fabric webs of this type are widely used at the present time for a large variety of materials for liquid take-up purposes, as insulation material, as linings, as fillings and even as fabrics for covering or lamination to other materials, there nevertheless is a desire to improve the strength of such materials for a given weight per unit area or, conversely, to reduce the weight per unit area for a given strength of the web.

OBJECTS OF THE INVENTION

It is, therefore, the principal object of the present invention to provide an improved method of making a mat or fleece of thermoplastic polymer filaments such that the strength of the finished web is increased while the elongation and residual shrinkage is decreased by comparison to webs made by earlier processes.

Another object of the invention is to provide an improved method of making a nonwoven web from thermoplastic filaments which, for a given area weight will have greater strength or for a given strength can be of reduced area weight.

Still another object of the invention is to provide a method of making a nonwoven web which reduces or eliminates drawbacks of earlier methods while yielding a product of improved quality and properties.

SUMMARY OF THE INVENTION

These objects and others which will become apparent hereinafter are attained in accordance with the present invention in a method of making a web of thermoplastic polymer filaments from a thermoplastic polymer having two supermolecular states of order, namely, a crystallite state and an amorphous state.

According to the invention, the polymer filaments are generated by a melt blown blowing head of the type wherein a plastic guide core is provided and has at least one row of nozzle orifices from which polymer melt emerges in the form of polymer streams against which flat jets of blowing air are directed in the region of the mouths of the orifices, the melt blown blowing head being so operated that long polymer filaments result.

According to the invention, the volume rate of flow of the polymer stream and the blowing air flat jets of the melt blown blowing head, the velocity of these jets and the temperature of the blowing air are so selected and controlled that the individual polymer filaments have a filament diameter of less than 100 μm and a degree of crystallinity of less than 45%.

According to the invention, moreover, the oriented polymer filaments which result are collected on a continuously moving sieve belt so that the polymer filaments bond at their crossing points with crossing weld locations to a coherent mat or fleece. The resulting mat or fleece is heated to a stretching temperature and is stretched by 100% to 400% both in the longitudinal direction and in the transverse direction, i.e. biaxially.

The biaxially stretched mat is then heated to a thermal fixing temperature above the stretching temperature which thermally fix the mat and yield the finished web. Important to the invention is the fact that the stretching and the thermofixing are so carried out that the polymer filaments in the finished web have at their centers a degree of crystallinity of at least 50%.

The degree of crystallinity in the polymer filaments is preferably, however, significantly greater, e.g. 75% to 80%.

The jets of blowing air have been referred to herein as flat jets and it will be understood that these jets can be sheet-blown streams of blowing air emerging from slit nozzles or flat streams arising from a multiplicity of aligned nozzle orifices composed of discrete jets. The polymer filaments upon leaving the melt blown blowing head generally are in an amorphous state. However, directly at the mouths of their respective orifices, these filaments are subjected to sudden cooling and stretching by the flat jets and blowing air but the transformation to a crystallite structure is limited at this stage so that the decree of crystallinity remains below 45%. The deposition of the polymer filaments on the belt can be supported by the application of suction below the belt.

According to a feature of the invention, the crossing weld locations should have diameters of at least 1 mm and this can be achieved by passing the web through a calender, i.e. between a pair of calender rolls, at least one of which can be heated.

Melt blown blowing heads are available in various configurations and mention may be made of those in EP 0 377 226 A1 and German patent document 4,036,734 (see also U.S. Pat. No. 5,248,247). In general such heads are used in the melt blowing process to produce polymer fibers, i.e. the short staple fibers mentioned previously.

However, it has now been found that with appropriate adjustment of the molten polymer flow rate and the velocity flow rate and temperature of the flat air jets, it is also possible to operate such heads so that they produce the long polymer filaments with which the invention is concerned and which bear no resemblance to the staple fibers which formerly were produced by such heads.

It has been found, surprisingly, that when thermoplastic polymer filaments are made with such a head, the degree of crystallinity can be held below 45% and polymer filaments made with diameters of less than 100 μm which are particularly suited to carrying out the present invention and which, in spite of the small diameter of these filaments, are self-bonding to other filaments at the crossing points of the filaments.

The filament diameter of the filament made by the present invention are extremely small by comparison with the filaments of webs made with earlier polymer filament process. In spite of the small diameter of these filaments, the danger of filament breakage during the biaxially stretching is minimal.

As a result, high-strength webs are achieved with reduced area weight, reduced elongation and highly limited shrinkage. Stated otherwise, with the process of the invention it is possible to produce webs of greater strength for a given area weight or a reduced area weight for a given strength and thus to effect a considerable saving in the amount of material used to produce a web. Of course the finished web can have ruptures of the polymer filaments and such breakages can even be at the crossing point wells as long as the number of these breaks is relatively small and does not adversely affect the web. The polymer filaments fabricated according to the invention have a rough surface which is particularly satisfactory for the formation of the fleece.

The method of the invention thus can comprise the steps of:

(a) feeding a molten thermoplastic synthetic resin having a crystallitic state and an amorphous state through a plastic guide core to a multiplicity of orifices in a melt-blowing head issuing polymeric filaments and directing flat jets of blowing air along a resulting curtain of the filaments from slit nozzles of the melt-blowing head having outlets in a region of the orifices, the melt-blowing head being operated such that the curtain consists of long filaments;

(b) controlling a volume rate of flow of the molten synthetic resin through the melt-blowing head, a velocity of the jets and a temperature of the blowing air that individual filaments of the curtain have a filament diameter of less than 100 μm and a degree of crystallinity of less than 45%;

(c) collecting filaments of the curtain in a mat on a continuously moving sieve belt so that the polymer filaments cross over one another and fuse together at crossover weld points to render the mat coherent;

(d) heating the mat formed in step (c) to a stretching temperature;

(e) biaxially stretching the mat heated to the stretching temperature in both a longitudinal direction and in a transverse direction by 100% to 400%;

(f) thermofixing the mat biaxially stretched in step (e) at a thermal fixing temperature which is greater than the stretching temperature; and (g) carrying out the biaxial stretching in step (e) and the thermofixing in step (f) so that the filaments in the thermofixed mat have at their centers a degree of crystallinity of at least 50%.

The stretching should be carried out such that there is no damage to the crossing weld points.

The stretching temperature in the range of 80° to 150° C. and a thermal fixing temperature of 180° to 200° C. have been found to be satisfactory.

In a preferred embodiment of the invention, the thermal fixing is carried out with hot air directed against the surface of the polymer filaments and under conditions in which the surfaces of the polymer filaments are melted at least in regions. This has been found to increase the strength of the polymer filaments.

Advantageously, the polymer filaments in the finished web have a degree of crystallinity of about 75% at least at the centers of these filaments. The welds between the filaments can form structures which are referred to as weld funnels and which are not through-welded, these structures being drawn flat in the biaxial stretching. Weld funnels which are not through-welded designate points between the polymer filaments which, however, do not homogeneously merge the thermoplastic materials of the two filaments where they are bonded together.

The thermal fixing can be effected in line, i.e. in a system in which the production of the polymer filaments, the formation of the mat, the stretching and the thermal fixing are effected in a single apparatus in a continuous process. It is also possible to carry out the thermal fixing off line, the mat being, for example, produced first up to, say, the biaxial stretching step, and being subsequently subjected to thermal fixing.

BRIEF DESCRIPTION OF THE DRAWING

The above and other objects, features, and advantages will become more readily apparent from the following description, reference being made to the accompanying drawing in which.

SPECIFIC DESCRIPTION AND EXAMPLE

Figure 1:
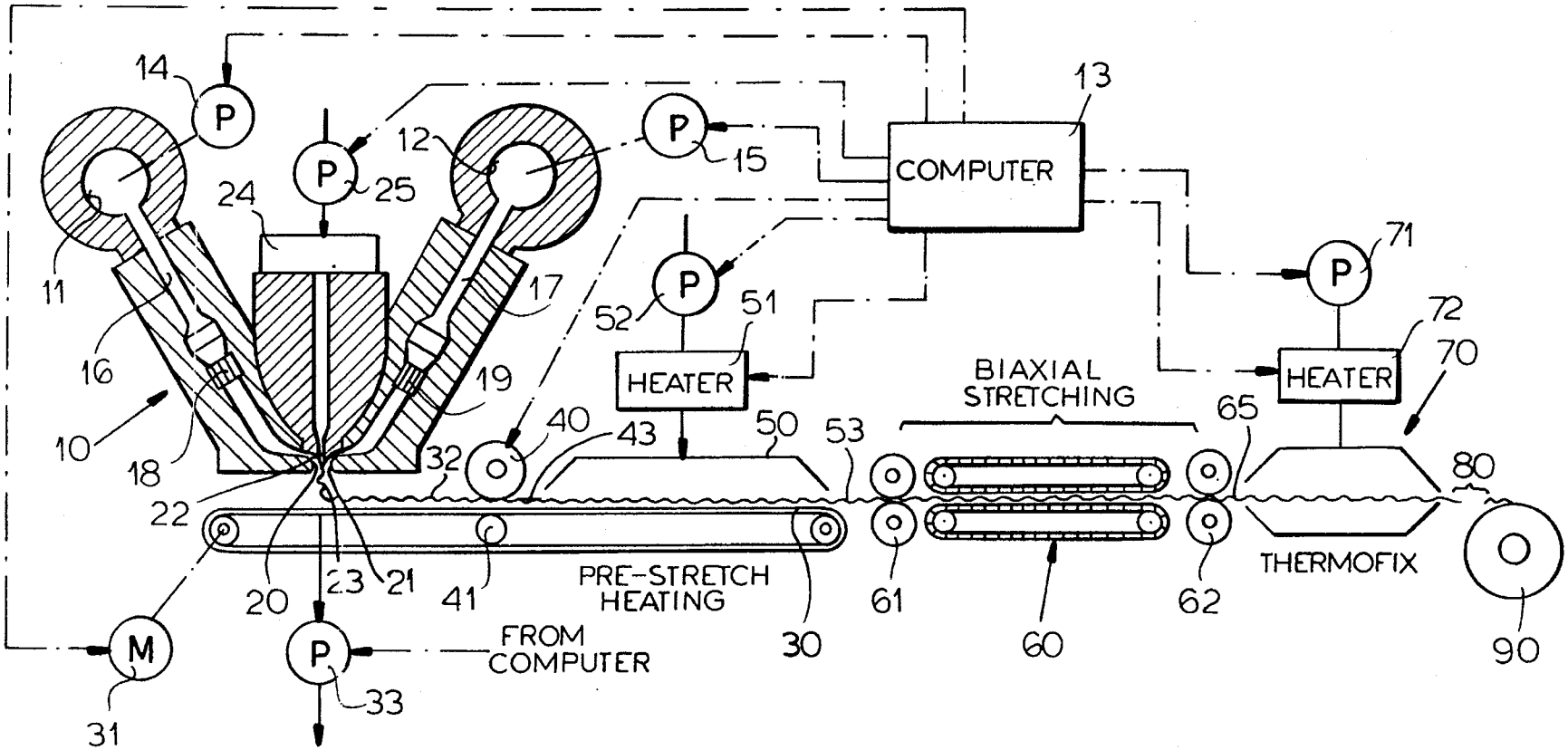
FIG. 1 is a diagrammatic side view of an in-line processing system according to the invention, showing the melt-blowing head in cross section.

As can be seen from FIG. 1, the present invention utilizes a melt-blowing head 10 which can be of the type described in U.S. Pat. No. 5,248,247 which comprises a pair of ducts 11 and 12 fed with air at a temperature controlled by a computer 13 via blowers 14 and 15 which feed the air through channels 16, 17 having flow orienting honeycombs or grids 18 and 19 to a pair of slot orifices 20 and 21 flanking a core 22 from a row of orifices of which a curtain 23 of molten thermoplastic emerges. The curtain is made up of a row of thermoplastic filaments which can be endless and which are cooled and stretched by the flat air jets.

The molten synthetic resin is fed to a melt chamber 24 supplied by the pump 25 at a volume rate of flow controlled by the computer 13.

The thermoplastic filaments, with diameters of less than 100 μm and preferably having a diameter between 30 and 90 μm and most advantageously between 50 and 95 μm, is collected on a sieve belt 30 driven by a motor 31 controlled by the computer 13 so that a mat 32 is formed on this belt. A suction pump 33 controlled by the computer 13 draws a suction from below the filament deposition surface of the belt to assist in forming the mat 32. The filaments are still of a temperature sufficient to enable cross-over weld points to be formed at the locations at which the filaments cross one another and rest upon one another.

A pair of calender rolls 40, 41 is provided to calender the mat 32 so that the calendered mat 43 which emerges has cross-over weld points of diameters in excess of 1 mm between the crossing filaments. The calender roll 40 maybe heated and the calender is controlled by the computer 13. When the calender roll is not sufficient to bring the mat 43 to the stretching temperature of 80° to 150° C., preferably 100° to 120° C., a hot air heating unit 50 can be provided to bring the mat to the stretching temperature. The heating unit 50, e.g. a hood, can be supplied with hot air through a heater 51 whose temperature is controlled by the computer 13 and which is supplied by a blower 52 also controlled by the computer 13. The stretching temperature is thus maintained within the indicated range. The biaxial stretching of the heated mat 53 is effected in the stretching station 60 which can have an upstream pair of rolls 61 which is driven at a certain speed and an upstream pair of rolls 62 driven at a higher speed to effect the longitudinal stretching of 100% to 400% and preferably around 300%. Transverse stretching is effected between pairs of diverging chains 63 and 64 so that a biaxially stretched mat 65 emerges from the biaxial stretching stage. The web can be coiled at this point, after appropriate cooling, if the thermal fixing is not an in-line fixing operation, i.e. is off-line.

In the embodiment shown in FIG. 1, however, the thermofixing step is effected at 70 in an in-line operation, the web 65 being brought to the thermofixing temperature of 180° to 200° C. by treating the web with hot air supplied by a pump 71 controlled by the computer 13, and a heater 72 whose temperature is determined by the computer 13 as well. After thermofixing, the web can be cooled in a stretch 80 before being wound up at 90.

Figure 3:
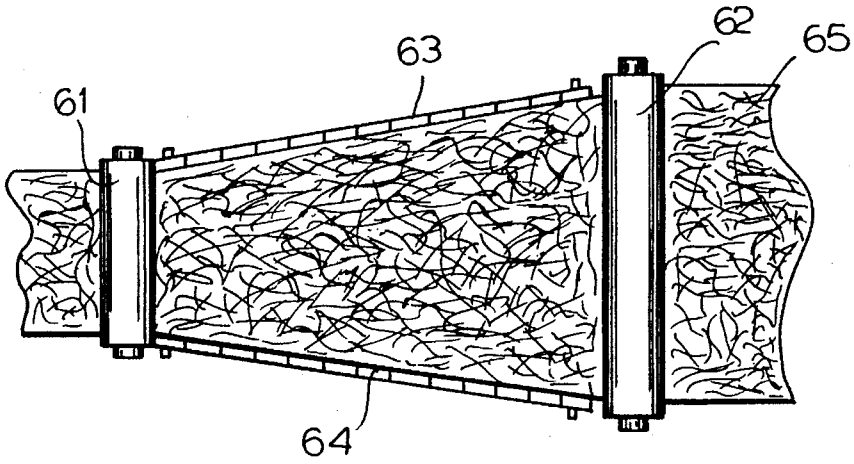
FIG. 3 is a diagrammatic plan view illustrating the biaxial stretching operation according to the invention.
Figure 2:
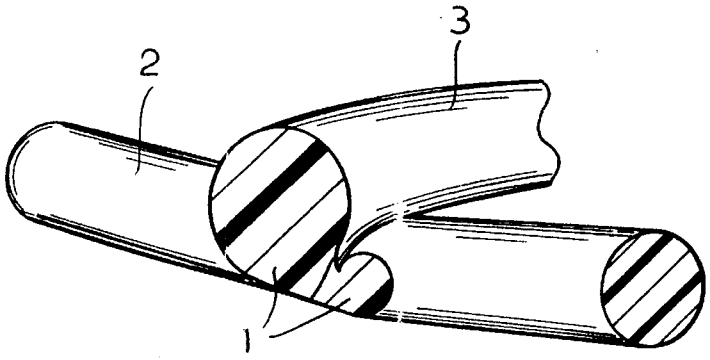
FIG. 2 is a perspective view illustrating the weld funnel drawn flat between two filaments of the web.

As can be seen in FIG. 2, a weld funnel can be formed at 1 between a pair of crossing filaments 2, 3 and is not through-welded in the sense that the fused thermoplastic does not blend together from the two filaments. During the stretching operation, FIGS. 1 and 3, the crossing weld structure 1 is drawn flat.

According to the invention in the thermal fixing step, the web is treated with hot air for a time sufficient to melt at least surface regions of the filaments. The filaments of the curtain 23 have a crystallinity less than 45% and preferably between 5 and 30%, most advantageously between 15 and 25%. The crystallinity following thermofixing at the centers of the filaments is at least 50% and most advantageously is 75 to 80%.

We claim:

1. A method of making a nonwoven web of thermoplastic polymeric filament, comprising the steps of:

(a) feeding a molten thermoplastic synthetic resin having a crystallitic state and an amorphous state through a plastic guide core to a multiplicity of orifices in a melt-blowing head issuing polymeric filaments and directing flat jets of blowing air along a resulting curtain of said filaments from slit nozzles of said melt-blowing head having outlets in a region of said orifices, said melt-blowing head being operated such that said curtain consists of long filaments;

(b) controlling a volume rate of flow of said molten synthetic resin through said melt-blowing head, a velocity of said jets and a temperature of said blowing air that individual filaments of said curtain have a filament diameter of less than 100 μm and a degree of crystallinity of less than 45%;

(c) collecting filaments of said curtain in a mat on a continuously moving sieve belt so that said polymer filaments cross over one another and fuse together at crossover weld points to render said mat coherent;

(d) heating the mat formed in step (c) to a stretching temperature;

(e) biaxially stretching the mat heated to said stretching temperature in both a longitudinal direction and in a transverse direction by 100% to 400%;

(f) thermofixing the mat biaxially stretched in step (e) at a thermal fixing temperature which is greater than said stretching temperature; and (g) carrying out the biaxial stretching in step (e) and the thermofixing in step (f) so that the filaments in the thermofixed mat have at their centers a degree of crystallinity of at least 50%.

2. The method defined in claim 1, further comprising the step of calendering the mat prior to heating the mat in step (d) so that said crossover weld points have diameters of at least 1 mm and are distributed longitudinally and transversely over said mat.

3. The method defined in claim 2, further comprising the step of controlling the stretching in step (e) so that said crossover weld points are practically not disrupted thereby.

4. The method defined in claim 3 wherein the thermoplastic synthetic resin is selected from the group which consists of polyamide polyester. polyethylene and polypropylene, and the degree of stretching in step (e) is about 300%.

5. The method defined in claim 4 wherein the stretching temperature of step (d) is maintained at 80° C. to 150° C.

6. The method defined in claim 5 wherein the thermal fixing temperature of step (f) is maintained at 180° C. to 200° C.

7. The method defined in claim 6 wherein the thermofixing in step (f) is carried out with hot air at a temperature and for a time sufficient to melt at least surface regions of the filaments.

8. The method defined in claim 7 wherein the crossover weld points are formed by funnel shaped formations connecting crossing filaments without fully merging materials of said filaments, and the funnel shaped formations are drawn flat by the biaxial stretching.

9. The method defined in claim 7 wherein steps (c) through (g) are carried continuously in line.

10. The method defined in claim 7 wherein steps (d) through (g) are carried off line from steps (a) through (c).

11. The method defined in claim 1, further comprising the step of controlling the stretching in step (e) so that said crossover weld points are practically not disrupted thereby.

12. The method defined in claim 1 wherein the thermoplastic synthetic resin is selected from the group which consists of polyamide, polyester, polyethylene and polypropylene and the degree of stretching in step (e) is about 300%.

13. The method defined in claim 1 wherein the stretching temperature of step (d) is maintained at 80° C. to 150° C.

14. The method defined in claim 1 wherein the thermal fixing temperature of step (f) is maintained at 180° C. to 200° C.

15. The method defined in claim 1 wherein the thermofixing in step (f) is carried out with hot air at a temperature and for a time sufficient to melt at least surface regions of the filaments.

16. The method defined in claim 1 wherein the crossover weld points are formed by funnel shaped formations connecting crossing filaments without fully merging materials of said filaments, and the funnel shaped formations are drawn flat by the biaxial stretching.

17. The method defined in claim 1 wherein steps (c) through (g) are carried continuously in line.

18. The method defined in claim 1 wherein steps (d) through (g) are carried off line from steps (a) through (c).

* * * * *